United States Patent [19]

Harris et al.

[11] Patent Number: 4,644,302

[45] Date of Patent: Feb. 17, 1987

[54] MICROWAVE POWER DIVIDER

[75] Inventors: Ian R. Harris; Ewan W. Shepherd, both of Lothian, Scotland

[73] Assignee: Ferranti, plc, Cheshire, England

[21] Appl. No.: 823,628

[22] Filed: Jan. 29, 1986

[30] Foreign Application Priority Data

Feb. 1, 1985 [GB] United Kingdom ..... 8502614

[51] Int. Cl.[4] ..... H01P 5/19

[52] U.S. Cl. ..... 333/125; 333/238

[58] Field of Search ..... 333/121, 125, 127, 128, 333/136, 137, 238, 246; 455/325–327

[56] References Cited

U.S. PATENT DOCUMENTS

| | | | |
|---|---|---|---|
| 3,946,339 | 3/1976 | Oltman, Jr. et al. | 333/121 |
| 3,955,156 | 5/1976 | Fleming | 333/128 |
| 4,369,415 | 1/1983 | Schwarzmann | 333/127 |

*Primary Examiner*—Paul Gensler

*Attorney, Agent, or Firm*—Kerkam, Stowell, Kondracki & Clarke

[57] ABSTRACT

A divider is made from a layer (1) of conducting material carried on an insulating support (2). A first slotline (3) is formed in the conducting layer extending from a first input port (A). A second slotline (5, 6, 7) is formed at right-angles to and spaced from the end of the first slotline (3), extending between first and second output ports (C and D). Third and fourth slotlines (8, 9) extend from the end of the first slotline (3) to points on the second slotline spaced by a distance which is electrically short compared with one-quarter of a wavelength. The third and fourth slotlines (8, 9) are an odd multiple of quarter-wavelengths long. A resistor (10) is connected across the second slotline substantially midway between the ends of the third and fourth slotlines, and has a resistance such that the output ports are correctly terminated.

3 Claims, 4 Drawing Figures

MICROWAVE POWER DIVIDER

This invention relates to a microwave power divider, that is a microwave component which will divide a signal applied to a first port equally between them two other ports with a phase difference of 180° between them.

Microwave power dividers of various types are already known particularly for hollow-waveguide microwaves. Certain of the higher frequency bands in the microwave spectrum lead themselves to other types of waveguide. One of these is the stripline, in which the waveguide or the component is formed by conducting areas on one side of an insulating layer with a ground plane conducting layer on the other side. An alternative form is the solution, where the waveguide is formed by slots in a conducting layer carried on an insulating layer.

The present invention is concerned with slotline waveguide components. In order to divide an input signal into two equal anti-phase components it has in the past been necessary to use a stripline component. This had necessitated a slotline-stripline transition at each of the three ports of the device.

It is an object of the invention to provide a slotline microwave power divider which does not contain any stripline components or elements.

According to the present invention there is provided a microwave power divider which includes a layer of conducting material carried on one surface of an insulating support, a first slotline formed in said conducting layer and having one end connected to an input port, a second slotline formed in the conducting layer substantially at right angles to and spaced from the other end of said first slotline and connected at its ends to first and second output ports, third and fourth slotlines formed in the conducting layer each substantially an odd multiple of quarter-wavelengths long and extending from said other end of the first slotline to spaced points on the second slotline separated by a distance which is electrically small compared with one-quarter of a wavelength, and a resistor connected across said second slotline substantially midway between said spaced points and having a resistance such that each of the first and second output ports is correctly terminated.

The invention will now be described with reference to the accompanying drawings, in which.

Figure 1:
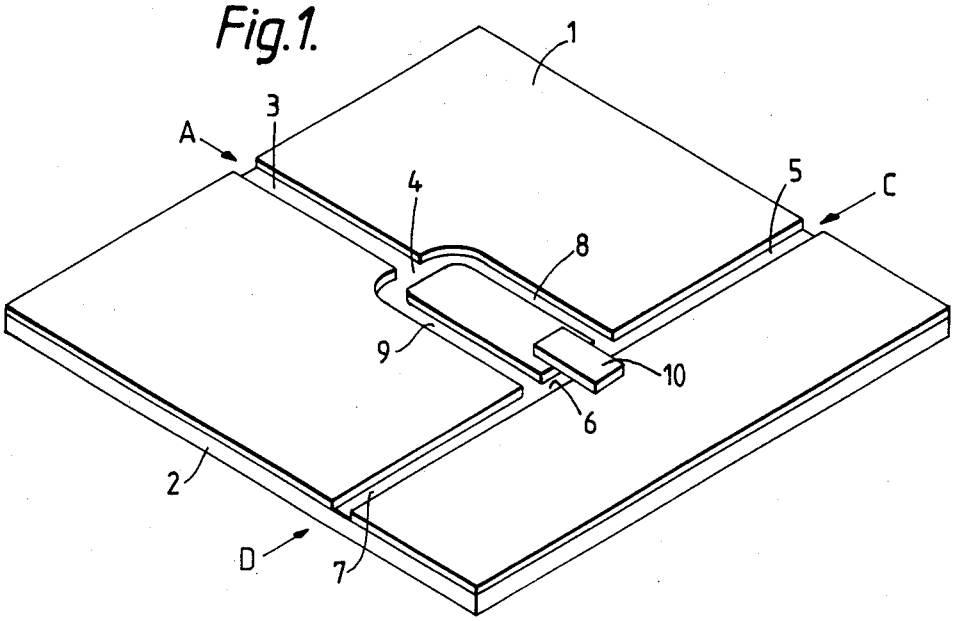
FIG. 1 is an isometric view of a power divider according to the invention.
Figure 2:
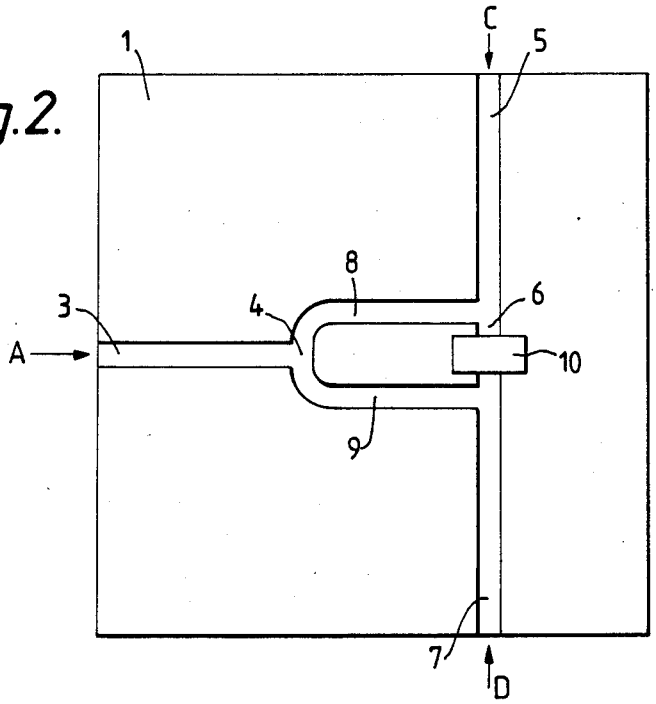
FIG. 2 is a plan view of the divider of FIG. 1.

Referring now to FIGS. 1 and 2, the coupler is made up from a layer of conducting material 1 carried on an insulating supporting board 2. Slots are cut through the conducting layer 1 to form a pattern of slotlines. A first slotline 3 extends inwards from a first input port A on the edge of the board. A second slotline extends across the board at right angles to the first slotline 3 and spaced from its inner end 4. As shown in FIG. 2 various parts of the second slotline are given references 5, 6 and 7. The ends of the second slotline are connected to first and second output ports C and D.

From the inner end 4 of the first slotline 3, third and fourth slotlines 8 and 9 of equal length extend to meet the second slotline so that the part 6 of the second slotline is that between the junction with slotlines 8 and 9. The slotlines 8 and 9 are each an odd number of quarter-wavelengths long at the desired operating frequency and, in this embodiment, extend substantially parallel to one another.

A resistor is formed on a chip or substrate 10 which is positioned so that the resistor is electrically connected to the conducting layer on each side of slotline 6 midway along its length. The value of the resistor is such that a matched termination is presented to output ports C and D.

The operation of the coupler detailed above will now be described with reference to FIGS. 3 and 4. In the equivalent circuits of FIG. 4, a matched slotline series junction such as that between slotlines 3, 8 and 9 is represented by a pair of transformers having their primary windings T1P and T2P connected in series and having their secondary windings T1S and T2S also connected in series. The two quarter-wave slotlines 8 and 9 are represented by transmission lines 21 and 22. The chip resistor is shown as resistance R. For the purposes of the following description it is assumed that any coupling between the quarter-wave slotlines 8 and 9 is neglected.

Figure 3:
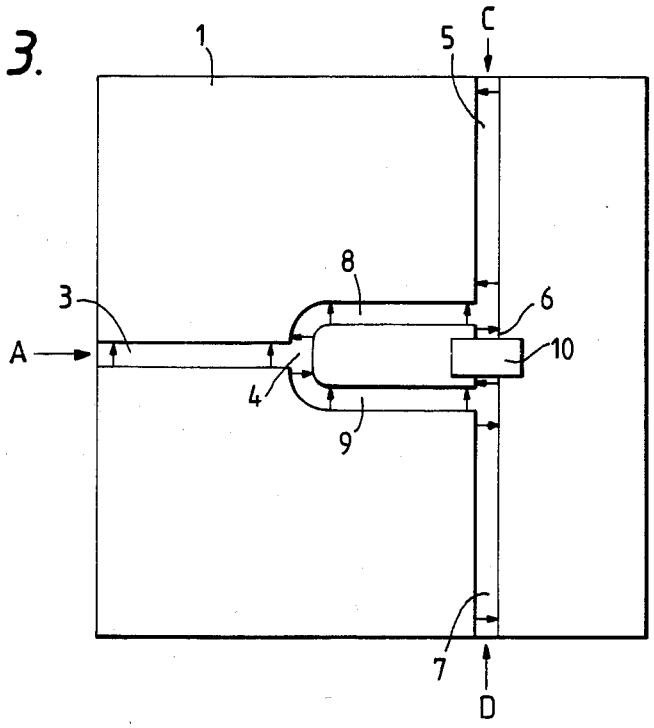
FIG. 3 illustrates the operation of the divider of FIG. 2.

FIG. 3 illustrates the electric fields existing in the coupler when an input signal is applied to port A. The signal propagates along the first slotline 3 to the junction 4. Here it divides to form two equal-amplitude anti-phase signals in slotlines 8 and 9. At the other ends of slotlines 8 and 9 the situation is repeated; for example at the junction with parts 5 and 6 of the second slotline equal-amplitude anti-phase signals are produced in the slotline parts 5 and 6. Anti-phase outputs are therefore produced at output ports C and D. In part 6 of the second slotline, if this is short compared with a quarter-wavelength then the signals produced from the two junctions cancel one another out. Hence there is no coupling to the resistor 10 and no signal is presented to it.

Figure 4:
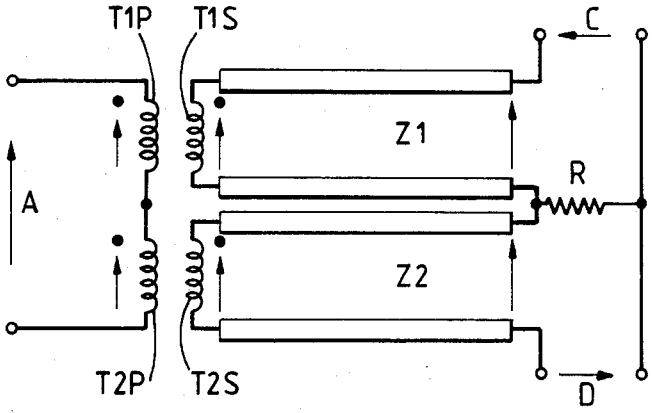
FIG. 4 is an equivalent circuit of the divider of FIG. 3.

FIG. 4 shows the electrical equivalent circuit of the situation just described. In this case the arrows indicate instantaneous voltages at various parts of the circuit. As shown, a voltage at port A is divided equally between the primary windings T1P and T2P, resulting in equal secondary voltages across windings T1S and T2S. These voltages are propagated along the two identical transmission lines Z1 and Z2 to ports C and D. Hence the input from port A divides into equal-amplitude anti-phase outputs from ports C and D.

If equal in-phase signals are applied to ports C and D, it will be seen that no signal emerges at port A and that the signals are in fact exclusively coupled into the terminating resistance R. There is thus complete isolation between port A and ports C and D. FIG. 1 shows the power divider made in the form of a rectangular board with the three ports located at its edges. In practice, however, it is more likely that the divider will be made on a larger board with internal terminations. The power divider described above has several advantages over existing forms of slotline power dividers, one important advantage being that the loss and mismatch effects of slotline-stripline transitions are avoided. In addition, a smaller area of substrate is required to make the device, and only one surface of the substrate needs to be machined or etched to form the component. Hence the divider should be cheaper to make and more efficient to use than previously-known types.

What we claim is:

1. A microwave power divider which includes a layer of conducting material carried on one surface of an insulating support, a first slotline formed in said conducting layer and having one end connected to a first input port, a second slotline formed in the conducting layer substantially at right-angles to and spaced from the other end of said first slotline and connected at its ends to first and second output ports, third and fourth slotlines formed in the conducting layer each substantially an odd multiple of quarter-wavelengths long and extending from said other end of the first slotline to spaced points on the second slotline separated by a distance which is electrically small compared with one-quarter of a wavelength, and a resistor connected across said second slotline substantially midway between said spaced points and having a resistance such that each of the first and second output ports is correctly terminated.

2. A divider as claimed in claim 1 in which the resistor is formed on a substrate positioned across the second slotline.

3. A coupler as claimed in claim 1 in which the third and fourth slotlines extend substantially parallel to one another.

* * * * *